US006227113B1

(12) United States Patent
Dorenkamp

(10) Patent No.: US 6,227,113 B1
(45) Date of Patent: May 8, 2001

(54) PRINTING MACHINE AND METHOD OF OPERATING A PRINTING MACHINE

(75) Inventor: Felix Dorenkamp, Hemsbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/287,154

(22) Filed: Apr. 6, 1999

(30) Foreign Application Priority Data

Apr. 6, 1998 (DE) ..... 198 15 293

(51) Int. Cl.[7] ..... B41F 31/00

(52) U.S. Cl. ..... 101/350.3; 101/348; 101/351.1

(58) Field of Search ..... 101/351.1, 350.3, 101/348, 352.06, 364, 219, 335, 492, 484

(56) References Cited

U.S. PATENT DOCUMENTS

| | | | | |
|---|---|---|---|---|
| 3,584,579 | * | 6/1971 | Rothenberg | 101/335 |
| 3,908,545 | | 9/1975 | Simeth . | |
| 4,841,861 | | 6/1989 | Difflipp et al. . | |
| 4,887,533 | * | 12/1989 | Lemaster et al. | 101/492 |
| 5,090,315 | * | 2/1992 | Lee et al. | 101/364 |
| 5,329,851 | * | 7/1994 | Momot | 101/348 |
| 5,447,102 | * | 9/1995 | Pfeiffer et al. | 101/492 |
| 5,511,474 | * | 4/1996 | Junghans | 101/348 |
| 5,566,613 | | 10/1996 | Stoffler et al. . | |
| 5,649,484 | * | 7/1997 | Broghammer et al. | 101/181 |
| 5,701,817 | * | 12/1997 | Thünker et al. | 101/484 |

FOREIGN PATENT DOCUMENTS

| | | |
|---|---|---|
| 598 010 | 4/1978 | (CH) . |
| 33 09 823 A1 | 10/1983 | (DE) . |
| 34 36 747 A1 | 6/1985 | (DE) . |
| 38 22 675 A1 | 1/1990 | (DE) . |
| 44 06 727 C2 | 9/1995 | (DE) . |
| 0 623 468 A1 | 11/1994 | (EP) . |
| 2 033 301 | 5/1980 | (GB) . |
| 1 578 801 | 11/1980 | (GB) . |
| 2 063 170 | 6/1981 | (GB) . |
| 2 193 926 | 2/1988 | (GB) . |

OTHER PUBLICATIONS

Japanese Patent Abstract JP 58–122876 (Fujishima), dated Jul. 21, 1983.

European Search Report, dated Mar. 27, 2000.

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

A method of operating a printing machine including an inking unit having a vibrator roller oscillatable reciprocatingly between an ink-duct roller and an inking-unit roller for making intermittent contact with the rollers, includes selectively operating the inking unit in a normal operating mode and in at least one reduced-ink operating mode wherein the ink-duct roller rotates with a movement characteristic different from that of the normal operating mode; a control method for the operating method; and a device for performing the operating method.

19 Claims, 5 Drawing Sheets

PRINTING MACHINE AND METHOD OF OPERATING A PRINTING MACHINE

BACKGROUND OF THE INVENTION

FIELD OF THE INVENTION

The invention relates to a method of operating a printing machine, more particularly, a printing machine including an inking unit having a vibrator roller that swings reciprocatingly between an ink-duct roller and an inking-unit roller and has intermittent contact with these rollers. The invention also relates to a printing machine, and more particularly, to a printing machine having an inking unit including a vibrator roller that swings reciprocatingly between an ink-duct roller and an inking-unit roller and has intermittent contact with these rollers.

In sheet-fed offset printing machines, the ink for printing is provided via so-called vibrator inking units having an ink-duct roller that cooperates with an ink duct and a metering device. The thickness of the ink layer on the ink-duct roller can be adjusted by the metering device on the ink duct. By intermittent contact with the ink-duct roller, a vibrator roller removes a strip of ink of specific length from the ink-duct roller and, during subsequent contact with an inking-unit roller, transfers this quantity of ink to precisely this inking-unit roller. By additional inking-unit rollers following the last-mentioned inking-unit roller, a multiple splitting of the quantity of ink fed by the vibrator roller is effected, and by suitably provided ink-applicator rollers, appropriate inking of the printing regions of the printing plate located on a plate cylinder is performed. In order to have an influence upon the quantity of ink conveyed from the ink duct into the inking unit, it is possible for the metering device to be adjusted so that the ink layer thickness on the ink-duct roller varies. However, the ink layer thickness on the ink-duct roller must not fall below a specific minimum value, that may be set reproducibly, in a reliable manner.

The published Non-prosecuted German Patent Application (DE-OS)27 20 371 describes a device for driving a ductor or ink-duct roller for inking units of printing machines, in which the quantity of ink is varied as a result of suitably controlling the mutual phase angle of the movements of the vibrator roller and the ink-duct roller by adjusting the position of driving and driven elements of a nonuniform gear mechanism, so that the instant of time of the controlling step of the vibrator roller against the ink-duct roller changes. If the quantity of ink is to be reduced, the region in which the ink-duct roller is stationary is partly shifted into the region in which the vibrator roller makes contact with the ink-duct roller. In the extreme case, contact between the vibrator roller and the ink-duct roller may take place during the time in which the ink-duct roller is stationary, so that the quantity of ink that is picked up is virtually equal to zero.

Although it is possible for the quantity of ink conveyed into the inking unit to be reduced, when the foregoing device is used, the method upon which the device is based can be used only in the case of devices having an ink-duct roller that is driven discontinuously. The device for performing the method described in the aforementioned published German patent application is additionally very complicated in terms of construction.

The published German Patent Document DE 44 06 727C2 describes a method of controlling the supply of fluid during the production of printed products, in which, following the input of a command effecting a change in the speed of the printing machine, but before the speed change is executed, the rate of supply of the fluid is changed in accordance with a predefined time function and, following a preselected number of machine revolutions, the speed change of the main drive is initiated. This may be performed by initiating a speed change of an ink ductor before the speed change of the printing machine. The movement characteristic of the ink ductor is always maintained.

With this method, although an ink change on the printed material during the change of the printing speed can be avoided, it is not possible for any reliably reproducible minimum supply rate to be achieved.

SUMMARY OF THE INVENTION

It is accordingly an object of the invention to provide a method of operating a printing machine by which a reliably reproducible minimum supply of ink into an inking unit is ensured and which can be used even in the case of inking units having a continuously driven ink-duct roller. Furthermore, it is also an object of the invention to provide a printing machine, in particular, for performing or implementing the method, which can be operated conveniently, and is of uncomplicated construction.

With the foregoing and other objects in view, there is provided, in accordance with one aspect of the invention, a a method of operating a printing machine including an inking unit having a vibrator roller oscillatable reciprocatingly between an ink-duct roller and an inking-unit roller for making intermittent contact with the rollers, which comprises selectively operating the inking unit in a normal operating mode and in at least one reduced-ink operating mode wherein the ink-duct roller rotates with a movement characteristic different from that of the normal operating mode.

In accordance with another mode, the method of the invention includes continuously rotating the ink-duct roller in the normal operating mode.

In accordance with a further mode, the method of the invention includes rotating the ink-duct roller nonuniformly, in the at least one reduced-ink operating mode.

In accordance with an added mode, the method of the invention includes rotating the ink-duct roller discontinuously, in the at least one reduced-ink operating mode.

In accordance with an additional mode, the method of the invention includes selectively operating the inking unit in one of a plurality of reduced-ink operating modes differing from one another with respect to the extent of the ink reduction therein.

In accordance with yet another mode, the method of the invention includes, in the at least one reduced-ink operating mode, rotating the ink-duct roller nonuniformly so that the oscillatable vibrator roller comes into contact with the ink-duct roller at least once when the ink-duct roller is rotating at a first speed, and comes into contact with the ink-duct roller at least once when the ink-duct roller is rotating at a second speed that is lower than the first speed.

In accordance with yet a further mode, the second speed has a zero value and the ink-duct roller is stationary when the vibrator roller makes contact with the ink-duct roller.

In accordance with yet an added mode, the method includes performing a changeover from the normal operating mode to the at least one reduced-ink operating mode when, in the normal operating mode, the rotational speed of the ink-duct roller falls below a minimum value.

In accordance with yet an additional mode, the method includes selecting the operating modes automatically by an electronic control device.

In accordance with still another mode, the method includes selecting the operating modes automatically by programmable electronic control equipment having a microprocessor.

In accordance with another aspect of the invention, there is provided a control method for implementing the operating method, which includes performing a selection of the operating modes and a changeover of the inking unit to the respectively optimal operating mode under program control by electronic control equipment.

In accordance with an added aspect of the invention, there is provided a printing machine, comprising an inking unit having a vibrator roller reciprocatingly oscillatable between an ink-duct roller and an inking-unit roller and making intermittent contact with the rollers, the inking unit being constructed so as to be selectively operatable in a normal operating mode and in at least one reduced-ink operating mode wherein the ink-duct roller rotates with a movement characteristic differing from that in the normal operating mode.

In accordance with another feature of the invention, the printing machine includes a drive separate from a main drive of the printing machine for driving the ink-duct roller.

In accordance with a further feature of the invention, the drive is a separate electric motor.

In accordance with an added feature of the invention, in the normal operating mode, the ink-duct roller is drivable by the drive so as to rotate continuously.

In accordance with an additional feature of the invention, in the reduced-ink operating mode, the ink-duct roller is drivable by the driver so as to rotate nonuniformly.

In accordance with yet another feature of the invention, in the reduced-ink operating mode, the ink-duct roller is drivable by the driver so as to rotate discontinuously.

In accordance with yet a further feature of the invention, the inking unit is constructed so that it is selectively operatable in one of a plurality of reduced-ink operating modes differing from one another with respect to the extent of the ink reduction therein.

In accordance with yet an added feature of the invention, in the at least one reduced-ink operating mode, the ink-duct roller is rotatable nonuniformly by the drive so that the oscillatable vibrator roller makes contact with the ink-duct roller at least once when the ink-duct roller is rotating at a first speed, and makes contact with the ink-duct roller at least once when the ink-duct roller is rotating at a second speed that is lower than the first speed.

In accordance with yet an additional feature of the printing machine of the invention, the second speed has a zero value, and the ink-duct roller is stationary when the vibrator roller makes contact with the ink-duct roller.

In accordance with still another feature, the printing machine of the invention includes electronic control equipment for selecting the optimal operating mode and for switching the printing machine over to this operating mode.

In accordance with a concomitant feature of the invention, the selection and the switchover are performable as a function of current operating conditions on the printing machine.

The invention takes a direction that is opposite to the teaching imparted by the prior art in the published Nonprosecuted German Patent Application DE-OS 27 20 371. The abovementioned prior art teaches that the exact adjustment of the ink metering is very complicated, because a different deformation of the ink knife occurs at different ink-duct roller rotational speeds and under the different hydrodynamic pressure associated therewith. The cause for the deficiency is seen in the fact that a metering change is always associated with a change in the characteristic of the movement of the ink-duct roller, and therefore the entire dynamic behavior of the device also changes.

The invention is based upon the surprising finding that the deformation of the ink knife as a result of different hydrodynamic pressure does not play a significant role in ink ducts having a modern metering device. Furthermore, it has been found according to the invention that the printing machine may be constructed particularly uncomplicated by changing the characteristic of the movement of the ink duct. The selective operation of the inking unit in a normal operating mode and in at least one reduced-ink operating mode permits very convenient operation of the printing machine and particularly quick adaptation of the quantity of ink conveyed in the inking unit under changing pressure and/or operating conditions. Depending upon the quantity of ink which is required for a printing process, the ink-duct roller rotates, in the method according to the invention, selectively in accordance with a first movement or motion law in the normal operating mode and in accordance with at least one second movement or motion law in at least one reduced-ink operating mode.

For example, the ink-duct roller may either rotate continuously in the normal operating mode and discontinuously in the reduced-ink operating mode, or discontinuously in the normal operating mode and continuously in the reduced-ink operating mode.

In one embodiment of the method according to the invention, provision is preferably made for the ink-duct roller to rotate continuously in the normal operating mode. This embodiment makes it possible for the ink-duct roller to be driven by a cost-effective drive, for example an electric motor. The ink-duct roller is preferably driven by a separate, controllable electric drive. However, the ink-duct roller may also be driven by a mechanical drive that is derived from the printing unit drive. The ink-duct roller may also be driven discontinuously in the normal operating mode and, for example, may rotate step by step. The speed of the continuously rotating ink-duct roller is preferably coupled to the machine speed (printing speed). In the case of the step-by-step drive, the speed and also the stepping frequency may be coupled to the machine speed.

A further embodiment is characterized in that the ink-duct roller rotates nonuniformly, in particular discontinuously, in the reduced-ink operating mode. There is nonuniform rotational movement of the ink-duct roller if the ink-duct roller is accelerated or decelerated while the machine speed (printing speed) is constant. The discontinuous rotational movement of the ink-duct roller is a preferred special case of the nonuniform rotational movement. In this case, the ink-duct roller executes an intermittent rotational movement and is intermittently stationary in the reduced-ink operating mode.

In this manner, the quantity of ink conveyed into the inking unit may be reliably and reproducibly reduced. No complicated mechanical gear mechanism is needed for this. In the case of an ink-duct roller that is driven by an electric motor, the electric motor may be accelerated and decelerated periodically or stopped cyclically.

In a further mode of the method, the inking unit is operated selectively in one of a number of reduced-ink operating modes, the reduced-ink operating modes differing from one another with respect to the extent of the ink reduction therein. By graduating the reduced-ink operating modes, the respectively optimal reduced-ink operating mode can be selected for different operating and/or printing conditions. Selecting the optimal operating mode as a function of the quantity of ink needed for a printing process may be performed so that the inking unit is operated with the smallest possible quantity of ink that is permissible for fault-free operation. Changing over or switching over from the normal operating mode to the at least one reduced-ink operating mode may be performed as a function of a reduction in machine speed, and from a reduced-ink operating mode to the normal operating mode as a function of an increase in machine speed. This applies as well to changing over or switching between a number of reduced-ink operating modes. The changeover or switching is preferably performed automatically.

In a further mode of the method, in the at least one reduced-ink operating mode, the ink-duct roller rotates nonuniformly so that the oscillating or swinging vibrator roller comes into contact with the ink-duct roller at least once when the ink-duct roller is rotating at a first speed, and comes into contact with the ink-duct roller at least once when the ink-duct roller is rotating at a second speed, the second speed being lower than the first speed. Of course, the periodically repeating vibrator cycle described hereinabove relates to a printing machine that is operated at constant machine speed (printing speed). The different speeds of the ink-duct roller within one operating mode should not be understood to mean any speed differences resulting from compensating the speed of the ink-duct roller in relation to the printing-machine speed. Instead, the vibrator roller makes contact with the ink-duct roller a first time when the ink-duct roller is rotating at a slower speed, and the vibrator roller subsequently makes contact with the ink-duct roller a second time when the ink-duct roller is rotating at a higher speed, the printing machine maintaining a constant speed. The second contact between the vibrator roller and the ink-duct roller may follow the first contact directly, that is to say, the vibrator roller, following the first contact with the ink-duct roller, swings or oscillates towards the inking-unit roller and back again towards the ink-duct roller and then makes contact with the ink-duct roller when the latter is rotating at a changed speed, this procedure being repeated periodically, so that the vibrator roller alternately makes contact with the more rapidly and more slowly rotating ink-duct roller. However, provision may likewise be made for the vibrator roller to make contact several times after one another with the slowly rotating ink-duct roller and, subsequently, to make contact several times after one another with the more rapidly rotating ink-duct roller. For example, the vibrator roller makes contact with the ink-duct roller twice in immediate succession when the latter is rotating slowly, then twice in succession when the latter is rotating more rapidly, then again twice in succession when it is rotating slowly, and so on. In this way, very many operating characteristics of the ink-duct roller may be implemented in the reduced-ink operating modes, these characteristics corresponding optimally to the operating conditions.

In a further mode of the method according to the invention, the second speed has the value zero and the ink-duct roller is stationary when the vibrator roller makes contact with the latter. In this preferred special case of the aforedescribed embodiment also, the intervals of the ink-duct roller rotation are repeated periodically. In this way, the quantity of ink conveyed into the inking unit may be reduced to an extremely small extent. It is thus possible, if there is an ink metering device assigned to the ink-duct roller and metering the printing ink differently over the printing width, for the zone openings to be kept open, even when the ink demand from the printing process is at its lowest, and the option is provided of being able to correct the metering elements of the ink metering device again in the "plus" and "minus" senses, so that the inking profile set transversely to the printing direction can be corrected effectively, even for the lowest ink demand from the printing process.

In a further mode of the method according to the invention, selection of the operating modes is performed by electronic control equipment. The electronic control equipment may contain a microprocessor and may be programmable so that the selection of the operating modes and the switchover of the inking unit into the optimal operating mode are performed automatically. This simplifies the supervision and operation of the printing machine. The electronic control equipment then controls the control processes described hereinabove and hereinbelow, in particular in the exemplary modes and embodiments, in accordance with a programmed control method, in the event that the method according to the invention is implemented in the printing machine according to the invention.

The printing machine, in particular, for implementing the method, includes an inking unit having a vibrator roller that oscillates or swings reciprocatingly between an ink-duct roller and an inking-unit roller and has intermittent contact with these rollers, the inking unit being constructed so that it can be operated optionally in a normal operating mode and in at least one reduced-ink operating mode, the ink-duct roller, in the reduced-ink operating mode, rotating with a movement characteristic that differs from the movement characteristic during operation in the normal operating mode.

In one embodiment of the printing machine according to the invention, the ink-duct roller is driven by a drive that is separated mechanically from a main drive of the printing machine. The ink-duct roller is preferably driven by a controllable, separate drive. The drive of the ink-duct roller may, for example, be coupled electronically to the printing machine, so that the ink-duct roller can be driven as a function of the printing machine speed. A separate drive of the ink-duct roller permits particularly uncomplicated construction of the printing machine. However, it is also possible to provide a drive, for the ink-duct roller, which is connected by a gear mechanism to the main drive of the printing machine. Such a gear mechanism may be capable of being adjusted or switched over so that the inking unit can be operated selectively in the operating modes.

In a further embodiment of the printing machine, in the normal operating mode, the drive of the ink-duct roller rotates the latter continuously.

In a further embodiment of the printing machine, in the reduced-ink operating mode, the drive of the ink-duct roller rotates the latter nonuniformly, in particular discontinuously.

In a further embodiment of the printing machine, the inking unit is constructed so that it can be operated selectively in one of a number of reduced-ink operating modes, the reduced-ink operating modes differing from one another in terms of the extent of the ink reduction therein.

In a further embodiment of the printing machine, in the at least one reduced-ink operating mode, the drive of the ink-duct roller rotates the ink-duct roller nonuniformly so that the swinging vibrator roller comes into contact with the ink-duct roller at least once when the ink-duct roller is rotating at a first speed, and comes into contact with the ink-duct roller at least once when the ink-duct roller is rotating at a second speed, the second speed being lower than the first speed.

In a further embodiment of the printing machine, the second speed has the value zero and the ink-duct roller is stationary when the vibrator roller comes into contact with the ink-duct roller. This embodiment is a special case of the embodiment described above.

In a further embodiment of the printing machine, electronic control equipment is provided that selects the optimal operating mode and switches or changes over the printing machine to this operating mode. In this way, particularly reliable changing of the operating modes as a function of the current operating requirements of the printing machine is achieved, in particular, in the case of rapidly changed operating conditions.

The printing machine is preferably constructed as a rotary printing machine, for example a sheet-fed rotary printing machine. The printing machine may operate using direct or indirect planographic printing processes or letter press printing processes. For example, the printing machine may be constructed as a sheet-fed offset printing machine. The aforementioned printing-machine types are particularly suitable for implementing the method according to the invention.

Other features which are considered as characteristic for the invention are set forth in the appended claims.

Although the invention is illustrated and described herein as embodied in a printing machine and a method of operating a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
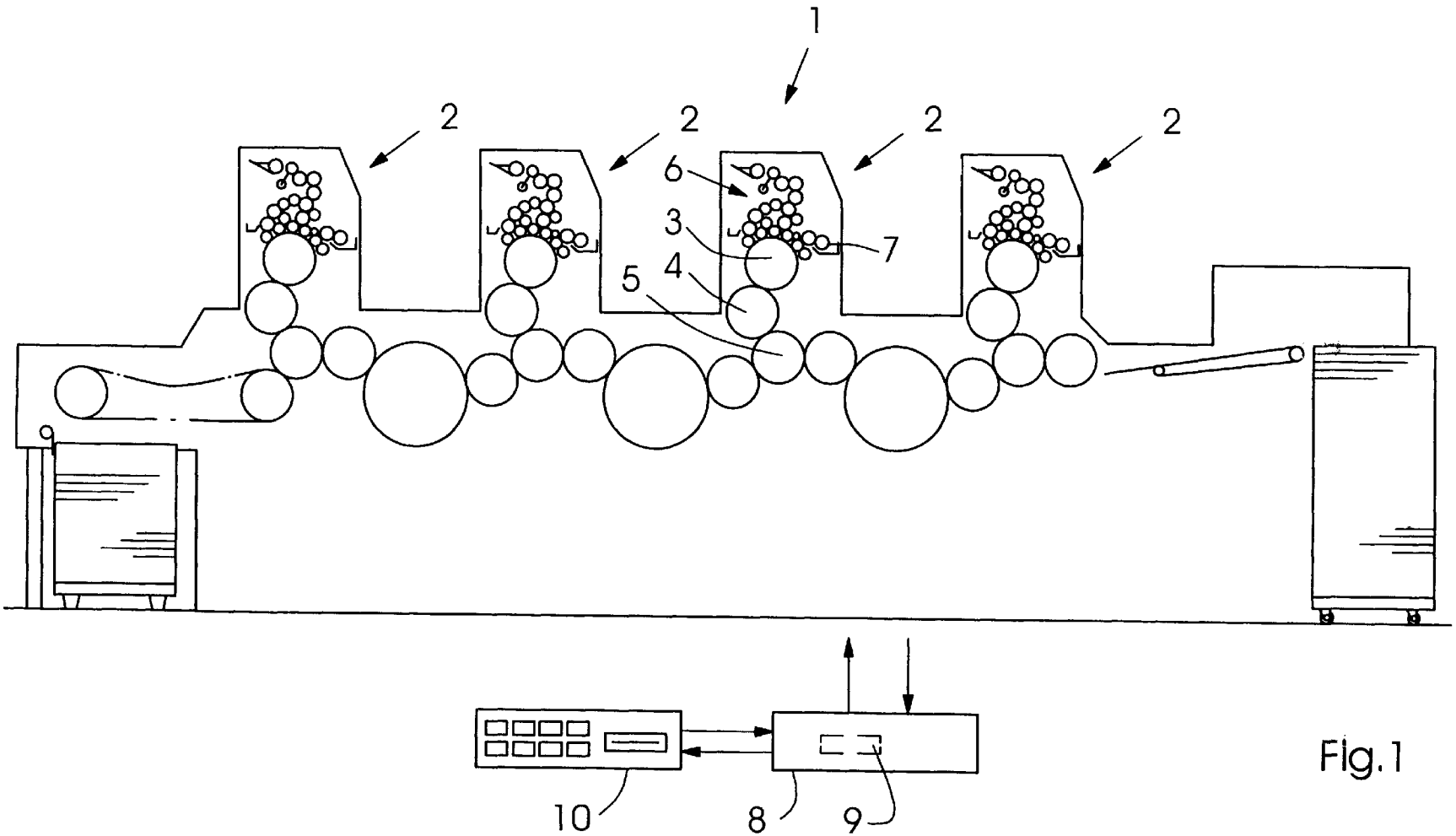
FIG. 1 is a diagrammatic side elevational view of a printing machine according to the invention.

Referring now to the drawings and, first, particularly to FIG. 1 thereof, there is illustrated therein a printing machine 1 according to the invention, which includes at least one printing unit 2, actually four printing units 2 in this embodiment. The printing machine 1 is constructed as a sheet-fed rotary offset printing machine. Each printing unit 2 has a plate cylinder 3, a blanket cylinder 4, an impression cylinder 5 and an inking unit 6 for applying the printing ink to a plate mounted on the plate cylinder 3. Furthermore, each printing unit 2 may include a dampening unit 7 assigned to the inking unit 6. The printing machine 1, each printing unit 2 and each inking unit 6 are controlled by electronic control equipment 8 having at least one microprocessor 9. The electronic control equipment 8 can be adjusted and programmed via an operating console 10.

Figure 2:
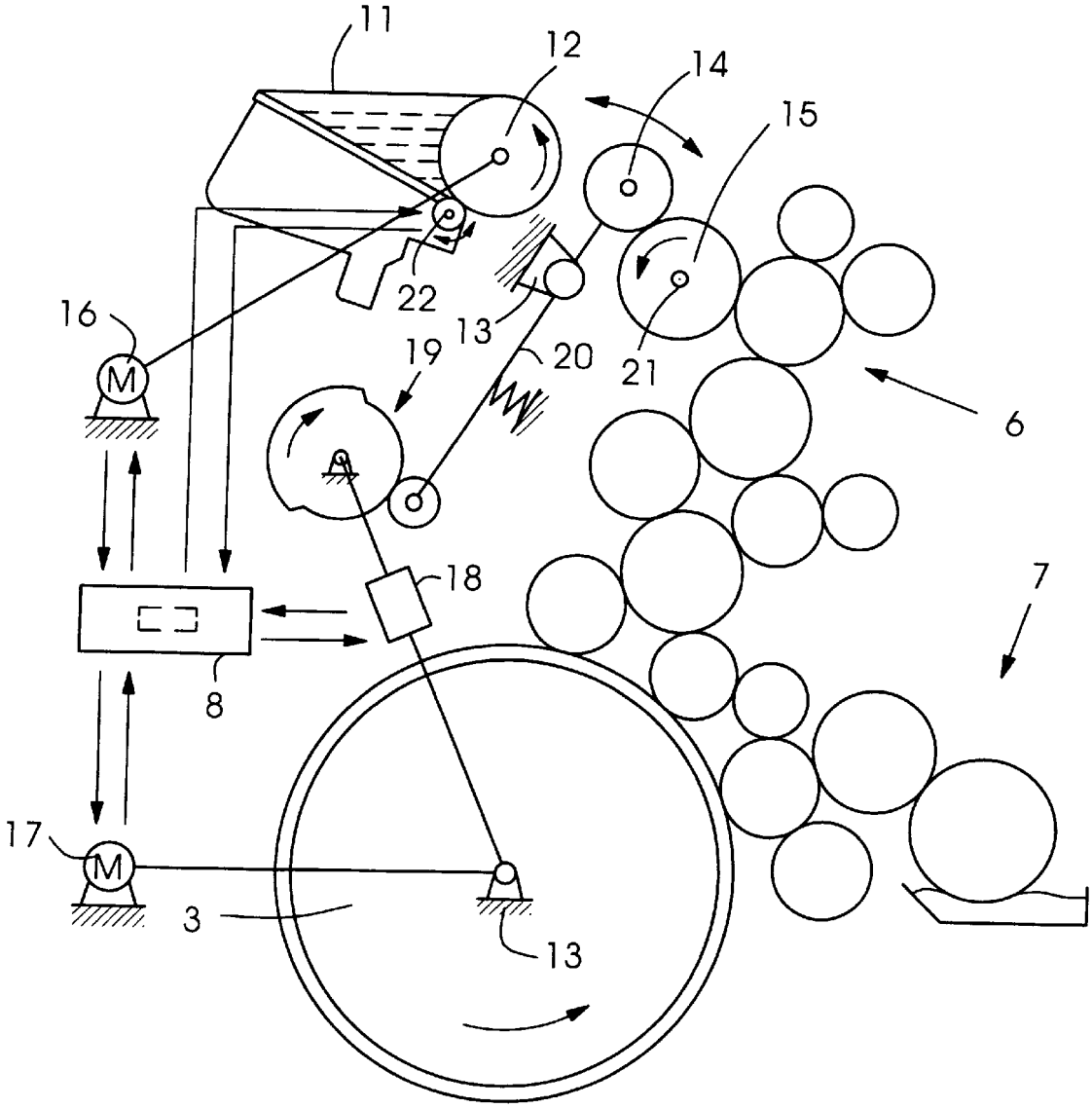
FIG. 2 is an enlarged fragmentary view of FIG. 1 showing in greater detail an inking unit of the printing machine.

FIG. 2 provides a more detailed illustration of the inking unit 6, which includes an ink duct 11 with an ink-duct roller or ductor 12, and an ink metering device 22 assigned to the ink duct 11 and the ink-duct roller 12. The inking unit 6 further includes not only a vibrator roller 14 and an inking-unit roller 15, but also, additional inking-unit rollers for feeding and applying printing ink. The ink-duct roller 15 is preferably constructed as a distributor roller that executes a lateral oscillating movement in the direction of the axis of rotation 21 thereof. The vibrator roller 14 swings reciprocatingly between the ink-duct roller 12 and the inking-unit roller 15. The vibrator roller 14 may swing rectilinearly to and fro between the rollers 12 and 15. However, the swinging of the vibrator roller 14 is preferably performed, as shown, via a pivoting movement. To this end, the vibrator roller 14 is disposed on a pivoting lever 20, that is mounted so that it can rotate in the frame 13. The pivoting lever 20 is driven by a cam mechanism 19. The cam mechanism 19 is driven by a drive 17. The drive 17 is preferably the main drive of the printing machine 1, and also drives the printing unit 2 and the plate cylinder 3. By the use of an adjusting device 18, the number of swings of the vibrator roller 14 from the ink-duct roller 12 to the inking-unit roller 15 and back to the ink-duct roller 12 can be set variably, with reference to a specific number of revolutions of the plate cylinder 3. However, the swinging movement of the vibrator roller 14 may also be provided by a drive that is independent of the main drive of the printing machine 1, for example, a pneumatic cylinder, it being possible for the synchronization of the separate drive of the vibrator roller 14 with the main drive of the printing machine 1 to be ensured by an incremental encoder and the electronic control equipment 8. The vibrator roller 14 makes contact alternately, in a defined rhythm or cycle with the ink-duct roller 12 and the first inking-unit roller 15 in the illustrated inking-roller train. When the ink-duct roller 12 is rotating at a specific speed during the time in which the vibrator roller 14 is in contact with the ink-duct roller 12, the ink-duct roller 12 transfers a strip or stripe of ink to the vibrator roller 14 that is rolling thereon at that time, this strip of ink being transferred from the vibrator roller 14 to the inking-unit roller 15 during the time in which the vibrator roller 14 is in contact with the latter, and being conveyed into the inking unit 6. The length of the strip of ink depends upon the contact time between the vibrator roller 14 and the ink-duct roller 12, and the rotational angle through which the ink-duct roller 12 is rotated while the vibrator roller 14 is in contact. In order to have an effect upon the amount of ink transferred, the ink layer thickness on the ink-duct roller 12 can be influenced by the ink metering device 22, by changing the rotational speed of the ink-duct roller 12 and by selecting the appropriate operating modes. The rotation of the ink-duct roller 12 is effected by the drive 16. The ink-duct roller 12 is preferably driven by a separate drive 16 that is independent of the main drive of the printing machine 1, as is shown in FIG. 2. By an incremental encoder, synchronization of a separate drive 16 with the main drive of the printing machine may be ensured, so that, in the event of a change in the printing-machine speed, the drive 16 drives the ink-duct roller 12 faster or more slowly, corresponding to the changes in the printing-machine speed. The synchronization of the rotation of the ink-duct roller 12 with the main drive 17 of the printing machine 1 may be performed in a directly proportional manner or in accordance with a different functional relationship (characteristic curve), and under the control of the electronic control equipment 8. However, provision may also be made for the ink-duct roller 12 to be driven rotatingly via a gear mechanism by the main drive 17 of the printing machine 1. In this case, the gear mechanism may be constructed so that it is adjustable in such a manner that the ink-duct roller 12 rotates selectively or optionally with different movement characteristics in different operating modes, depending upon the setting of the gear mechanism. In this case, synchronization between the phase relationship of the rotation of the ink-duct roller 12 and the rotation of the plate cylinder 3 is provided in a simple manner.

In addition to controlling the rotation of the ink-duct roller 12 and the plate cylinder 3, as well as the swinging or oscillating of the vibrator roller 14, the electronic control equipment 8 may also control the adjustment of the ink metering device 22. The illustrated inking unit 6 is preferably constructed so that the ink-duct roller 12 rotates continuously in a normal operating mode and rotates discontinuously in at least one reduced-ink operating mode. In the operating modes, i.e., both in the normal and in the reduced-ink operating modes, the rotational speed of the ink-duct roller 12 is preferably linked to the printing-machine speed. The movement of the vibrator roller 14 is likewise coupled with the printing-machine speed, and the vibrator roller 14 swings or oscillates preferably continuously.

Figure 3:
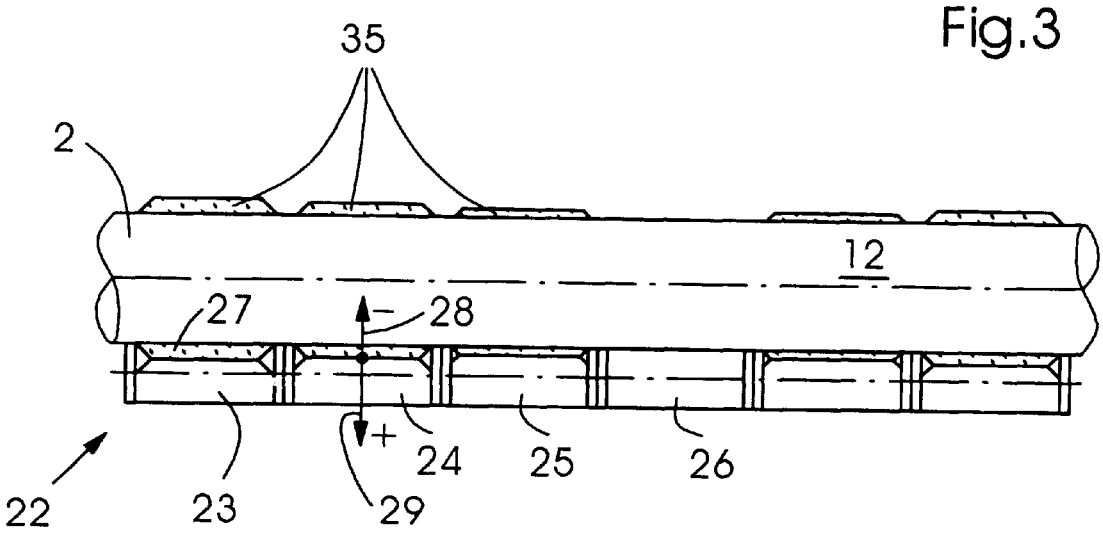
FIG. 3 is a fragmentary side elevational view of an ink-duct roller and an ink metering device of the inking unit.

FIG. 3 illustrates in greater detail the ink-duct roller 12 and the ink metering device 22 assigned thereto. The ink metering device 22 has zone-wide metering elements 23 to 26, the construction of which is described in the published German Patent Document DE 26 48 098 C3, corresponding to U.S. Pat. No. 4,242,958. The metering elements 23 to 26 are, in particular, constructed as the cylindrical embodiment described in this reference, which is constructed so that it can rotate in the circumferential direction. Metering elements of this type are also described and shown in the book entitled "Offsetdrucktechnik" [Offset Printing Technology], 6th completely revised edition, 1989, Fachschriftenverlag GmbH und Co KG, ISBN 3-921217, on page 414, and have been known for many years from the "Speedmaster" type of printing machine of the firm Heidelberger Druckmaschinen AG of Heidelberg, Germany. Instead of a detailed description of the ink metering device 22, the ink metering elements 23 to 26 and, a possibly present sheet or foil covering the ink metering elements 23 to 26, the aforementioned U.S. Patent should be considered to be included in its entirety in the description of the invention in the instant application. In the case of metering elements of this construction, changes in the movement characteristic of the ink-duct roller 12 do not cause any change in the ink film thickness as a result of different hydrodynamic forces of the ink. The reference to the U.S. patent that is mentioned hereinabove and is to be included herein serves primarily to demonstrate the reproducibility of the invention. It should be expressly emphasized at this point that, in conjunction with the invention, it is also possible to use ink metering devices of other constructions which have an ink metering element or elements with sufficient stability, so that these elements are not subject to any significant deformations even in the case of different movement characteristics of the ink-duct roller or, respectively, different ink-duct roller rotational speeds. FIG. 3 shows that the metering elements 23 to 26 can be adjusted to a different spaced distance from the ink-duct roller 12. The spaced distance of the metering elements 23 to 26 from the ink-duct roller 12 results in the formation of a spaced distance or a metering opening 27 between the respective metering element 23 and the circumferential surface of the ink-duct roller 12, depending upon the setting or adjustment in the individual inking zones. In the event that there is a non-illustrated sheet or foil inserted between the metering elements 23 to 26, on the one hand, and the ink-duct roller 12, on the other hand, the metering opening 27 is provided between the sheet or foil and the ink-duct roller 12. Due to the rotation of the ink-duct roller 12, a quantity of ink 35 corresponding to the zonal setting is conveyed out of the ink duct 11 and through each metering opening 27, and can be picked up or taken off by the vibrator roller 14. Each metering element 23 to 26 is constructed so that it can be adjusted in a negative adjustment direction represented by the arrow 28, and a positive adjustment direction represented by the arrow 29. If the adjustment is made in the positive adjustment direction of the arrow 29, the spacing of the metering elements 23 to 26 from the surface of the ink-duct roller 12 is increased, and the respective metering opening 27 is opened further, respectively, so that more printing ink is conveyed through the latter. If the adjustment is made in the negative adjustment direction of the arrow 28, the metering opening 27 is closed further, so that less printing ink can pass through the respective metering opening 27. As illustrated in FIG. 3, the metering element 24 is at a middle setting, so that it can be adjusted in both adjustment directions of the arrows 28 and 29. The metering element 26 is set so that the metering opening 27 assigned thereto is opened to a minimum extent or completely closed, and adjustment of the metering element 26 is then possible only in the positive direction of the arrow 29. The metering element 23 is set so that the metering opening 27 is opened to a maximum extent and adjustment of the metering element 23 is then possible only in the negative direction of the arrow 28. The adjustment of the illustrated metering elements 23 to 26, which are constructed as adjusting eccentrics, is performed by rotating them about the axis of rotation thereof. In order to exert any influence upon the quantity of ink conveyed out of the ink duct 11 by the ink-duct roller 12 per unit time or per printing-machine cycle, the ink metering elements 23 to 26 can be adjusted and the rotational speed of the ink-duct roller 12 can be varied, neither the ink layer thickness on the ink-duct roller 12 nor the rotational speed of the ink-duct roller 12, in practice, falling below specific minimum values, which can be reproduced reliably.

Figure 4:
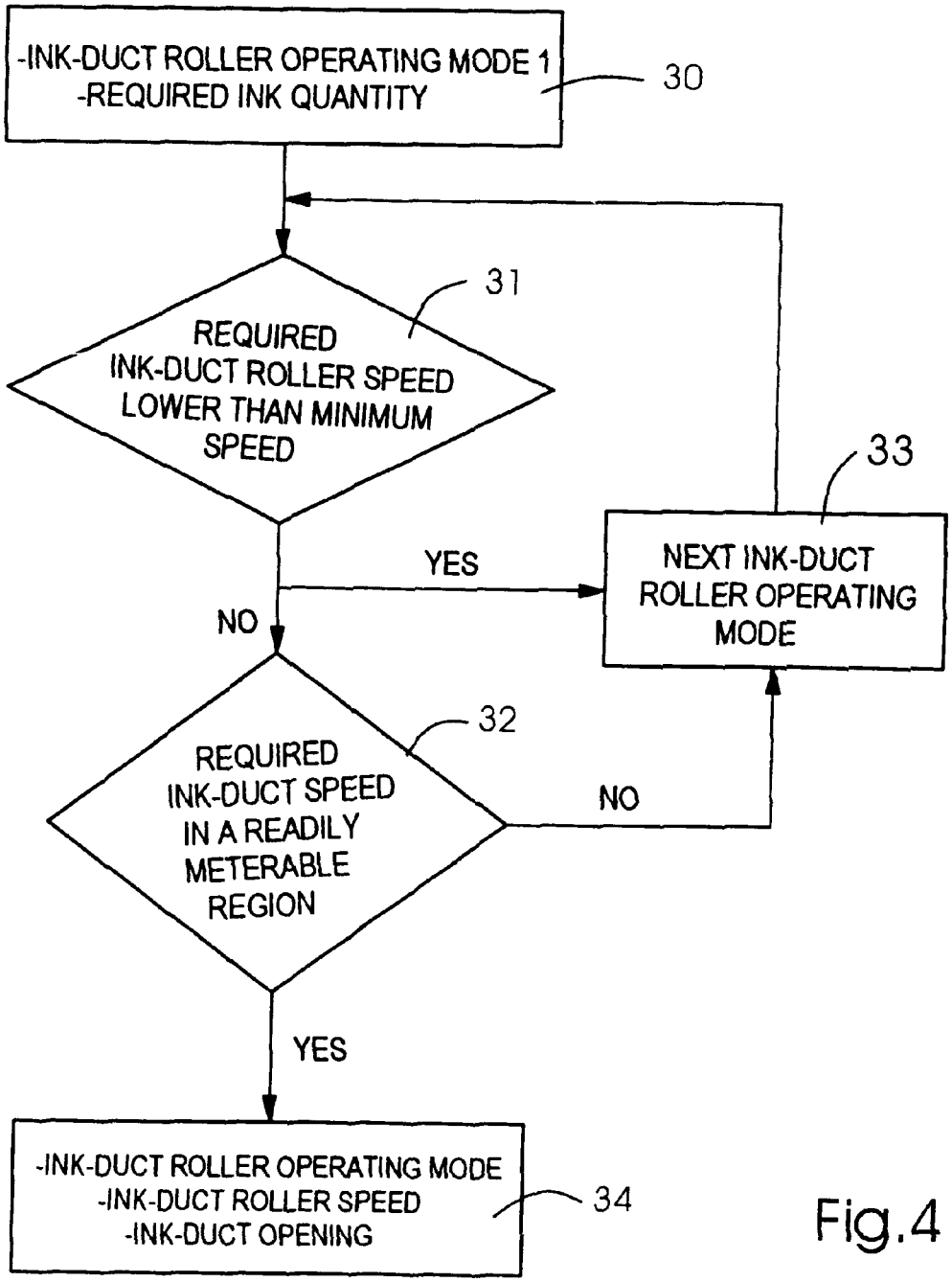
FIG. 4 is a flow chart depicting a program relating to the control of the printing machine and of the inking unit.

FIG. 4 illustrates a flow diagram which contains a preferred flow sequence for the method of operating the printing machine 1. The individual method steps are illustrated as program steps 30 to 34 in a program, in accordance with which the electronic control equipment 8 controls the printing machine 1 and the inking unit 6 in the case of the preferred automatic implementation of the method. In the program step 30, the inking unit 6 is operating in a first operating mode. This is, for example, the normal operating mode. In this regard, the ink-duct roller 12 rotates continuously and, given a constant machine speed, also rotates initially at a constant speed. In the event of a reduction in the printing-machine speed, the ink demand falls. The speed of the ink-duct roller 12 is changed, in a manner that is functionally dependent upon the change in the printing-machine speed, for example, proportionally to the printing machine speed, to an ink-duct roller speed that is lower and corresponds to the reduced quantity of ink required. Before lowering the speed of the ink-duct roller, the electronic control equipment 8 calculates what ink-duct roller speed is needed in order to implement the required quantity of ink at a reduced printing-machine speed, using as a basis therefor, characteristic curves, functions or value tables which are stored in its memory. In the following program step 31, the result of this calculation, namely the required ink-duct roller speed, is compared with a minimum speed stored in the electronic control equipment 8. If the required ink-duct roller speed is not less than the minimum speed, i.e., it is higher or the same, the program jumps to program step 32, and if the required ink-duct roller speed is less than the minimum speed, the program jumps to program step 33. At this point in the program, the control algorithm is at least one reduced-ink operating mode and at least one corresponding ink-duct roller type of operation, respectively, and preferably one of a number of graduated reduced-ink operating modes and ink-duct roller types of operation, respectively, for example, the operating modes represented in FIG. 5 in graphs c) to g) thereof, which may be programmed in the form of predefined subroutines. In the case of a number of operating modes, an inner counter loop that switches to the respectively following operating mode is additionally programmed at the point where program step 33 is called up. In the program step 33, it is thus possible to switch alternately to the next possible operating mode and to the next possible ink-duct roller type of operation, respectively. If the printing machine 1 were being operated in the normal operating mode before the program step 33, the reduced-ink operating mode is called up in the program step 33. If the printing machine 1 were already being operated in a reduced-ink operating mode before the program step 33, the next possible reduced-ink operating mode is called up in the program step 33, the quantity of ink conveyed in the latter mode being reduced to a specific extent with respect to the preceding reduced-ink operating mode. Before the printing machine is operated in the reduced-ink operating mode determined in the program step 33, a renewed comparison is performed between the ink-duct roller speed required in the determined reduced-ink operating mode and the minimum speed in the program step 33. If the ink-duct roller speed of the reduced-ink operating mode that was called up first is less than the minimum speed, the program jumps again from the program step 31 to the program step 33, in which the next reduced-ink operating mode is called up, this latter mode having an ink reduction that is still greater than that of the preceding reduced-ink operating mode. For example, the reduced-ink operating mode called for first may correspond to the operating mode illustrated in FIG. 5, graph c), and the second reduced-ink operating mode called for during the second pass through the loop 31, 33 may correspond to the operating mode illustrated in FIG. 5, graph d). The program runs through the loop 31, 33 until the optimum ink-duct roller speed which is not less than the minimum speed has been found. Once this condition has been satisfied, the program jumps from the program step 31 to the program step 32, in which the electronic control equipment 8 automatically decides, in accordance with programmed control strategies, whether the required metering opening 27 (FIG. 3) is set in a middle or central, readily or easily meterable region. The electronic control equipment 8 can be used for controlling the adjustments of the ink metering device 22, so that the current setting values of the metering elements 23 to 26 are available to the electronic control equipment 8. The metering opening 27 is in the middle, readily meterable region when the respective metering element 23 to 26 is adjustable both in the negative direction 28 and in the positive direction 29. In essence, it is sufficient if the electronic control equipment 8 monitors whether all the metering elements 23 to 26 can still be corrected and readjusted, respectively, in the negative direction 28. Due to the method according to the invention, it is thus possible to keep the zonal metering openings 27 open longer if a reduction in the printing-machine speed has occurred, without having to increase the quantity of ink conveyed into the inking unit. In this manner, the inking profile can be corrected over the printing width even in this operating condition of the printing machine. Furthermore, it is then possible to reduce the minimum quantity of ink that is conveyed into the inking unit 6 with the inking zones closed and at the minimum ink-duct speed, if individual or all of the inking zones are set to the closed position (FIG. 3, metering element 26). If the metering opening 27 is not in a region in which it can be adjusted in both adjustment directions represented by the arrows 28 and 29, or at least in the negative adjustment direction of the arrow 28, the program jumps from the program step 32 to the program step 33, in which the next possible reduced-ink operating mode is called for. Continuing the example begun hereinabove, this may be the reduced-ink operating mode shown in FIG. 5, graph c). The program runs through the loop 31, 32, 33 until the condition corresponding to the program step 32 is satisfied, so that the program jumps to the program step 34, and the printing machine 1 operates in an optimal operating mode, in which the ink-duct roller 12 rotates with an optimal ink-duct roller speed, and the metering openings 27 of the metering elements 23 to 26 are located in an optimally adjustable adjustment region. The monitoring of the setting of the ink metering device 22, to be performed in the program step 32, and the decision, to be made on this basis, to change the operating mode may also be performed visually or manually by the pressman operating the printing machine 1, instead of by the electronic control equipment 8. If the result of comparing the required ink-duct speed with the minimum speed in the program step 31 is that these speeds are precisely equal, it is possible in programming terms to provide a program jump to the program step 33 instead of the jump to the program step 32. The method of operating the printing machine, or the control method, is thus characterized by or offers the feature that the changeover from a first reduced-ink operating mode with a lower ink reduction to a second reduced-ink operating mode with a greater or more considerable ink reduction is performed if, in the first reduced-ink operating mode, the ink-duct roller speed falls below a minimum rotational speed. The method is also characterized by or offers the feature that the changeover from the normal operating mode to an optimal reduced-ink operating mode from a number of reduced-ink operating modes is performed if, in each of the reduced-ink operating modes that precedes the optimal reduced-ink operating mode, the rotational speed falls below the minimum. Furthermore, the method is characterized by or offers the feature that the ink-duct roller 12 is assigned to an ink duct 11, and the ink-duct roller 12 has an adjustable metering device 22 assigned thereto, the ink-duct roller 12 delivering an amount of printing ink from the ink duct 11 that corresponds to the setting of the metering device 22, and, following the changeover to a reduced-ink operating mode, in which the minimum rotational speed of the ink-duct roller 12 is ensured, a check is made to ascertain whether a subsequent correction of the adjustment in both adjustment directions represented by the arrows 28 and 29, or at least in one of the adjustment directions of the arrows 28 and 29, respectively, of the metering device 22, is still possible. Furthermore, the method is characterized by or offers the feature that when the control system determines that one end of the adjustment range or region has been reached, a changeover is made to a reduced-ink operating mode corresponding to the next step, the ink reduction in the latter mode being greater than that in the reduced-ink operating mode corresponding to the preceding step. Furthermore, the method is characterized by or offers the feature that the selection of the respectively optimal operating mode can be made by the operator. Furthermore, the method is characterized by or offers the feature that the control or check as to whether a correction to the setting of the metering device is possible in both adjustment directions represented by the arrows 28 and 29, or at least in the adjustment direction of the arrow 28, may be performed by the operator. Furthermore, the method is characterized by or offers the feature that, in a preferred embodiment, the check as to whether a correction to the setting of the metering device 22 is possible in both or one adjustment direction represented by the arrows 28 and 29 is performed automatically.

Figure 5:
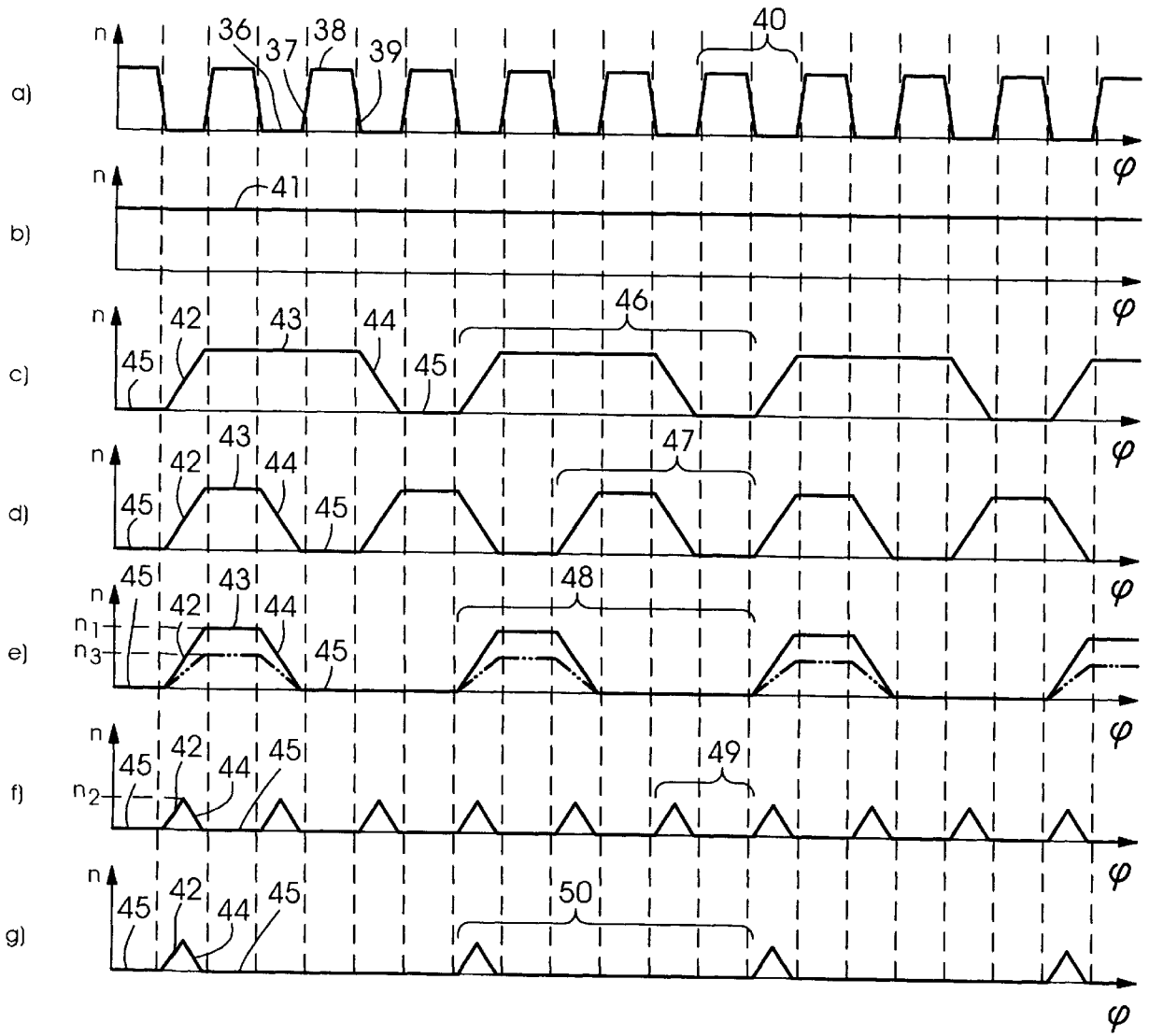
FIG. 5 is a series of plot diagrams or graphs illustrating a movement or motion characteristic of a vibrator roller and various movement or motion characteristics of an ink-duct roller of the inking unit according to the invention.

Graph a) in FIG. 5 shows the characteristic curve of the movement of the vibrator roller 14. The vibrator roller 14 reciprocatingly swings continuously between the ink-duct roller 12 and the inking-unit roller 15, the phase relationship between the vibrator-roller cycle and the phase angle of the printing unit preferably being produced by a rotational movement of the cam disk of the cam mechanism 19 that drives the vibrator roller 14, that rotational movement being picked off from the main drive 17 (FIG. 2) of the printing machine. The vibrator-roller movement (ordinate or y-axis) is plotted as a function of the rotational angle and the number of machine revolutions, respectively, (abscissa or x-axis), the phase 36 illustrating the contact between the vibrator roller 14 and the inking-unit roller 15, the phase 37 illustrating the movement of the vibrator roller 14 towards the ink-duct roller 12, the phase 38 illustrating the contact between the vibrator roller 14 and the ink-duct roller 12, and the phase 39 illustrating the movement of the vibrator roller 14 away from the ink-duct roller 12 and back towards the inking-unit roller 15. The oscillation or vibration cycle 40 of the vibrator roller 14 from the inking-unit roller 15 towards the ink-duct roller 12 and back again is repeated periodically, the vibrator roller 14 swinging continuously. Illustrated in graph b) of FIG. 5 is the movement characteristic of the ink-duct roller 12 in the normal operating mode, the y-axis in the graphs b) to g) of FIG. 5 illustrating the rotational speeds of the ink-duct roller 12, and the x-axis illustrating the number of machine revolutions and the rotational angle $\phi$, respectively. If the printing machine speed remains constant, the ink-duct roller 12 likewise rotates at a constant speed, the rotation 41 of the ink-duct roller 12 being continuous in the normal operating mode. The graphs c) to g) of FIG. 5 illustrate preferred refinements of the reduced-ink operating modes, the printing ink being reduced more and more and the ink supply rate decreasing, respectively, from the graph b) to the graph g). The reduced-ink operating modes illustrated in the graphs c) to g) are called for optionally in the program step 33 (FIG. 4), the program executing the loops 31, 33 and 31, 32, 33, respectively, and, during each loop-passthrough, calling up the operating mode following the current operating mode, beginning at the graph c) and progressing in the direction to the graph g). However, it is also possible for only a single operating mode or selected operating modes from the operating modes of the graphs c) to g) of FIG. 5 to be provided.

The first reduced-ink operating mode, illustrated in the graph c), is characterized by or is provided with the feature that, on the first occasion upon which the vibrator roller 14 comes into contact with the ink-duct roller 12, the ink-duct roller 12 is stationary, on at least two successive occasions, directly following the first occasion, on which contact is made, the ink-duct roller 12 rotates, on a further occasion on which contact is made, directly following the at least two occasions, the ink-duct roller 12 is stationary again, and on at least two successive occasions, directly following the further occasion, on which contact is made, the ink-duct roller 12 rotates again, and so on. This movement characteristic is repeated periodically. When the vibrator roller 14 makes contact with the ink-duct roller 12, the latter is stationary, so that the vibrator roller 14 does not roll on the ink-duct roller 12. In this way, when the ink-duct roller is stationary, an extremely short strip or stripe of ink is picked off the ink-duct roller 12 by the vibrator roller 14, this strip or stripe theoretically corresponding to a line which runs parallel to the axis and, in practice, because of the deformation of the elastic vibrator roller 14 and the over-running of the vibrator roller 14, which is rotationally driven by the inking-unit roller 15, possibly corresponding to a band of ink which extends in the direction parallel to the axis. In the graphs c) to g), the movement phases 42 to 45 of the ink-duct roller 12 are shown in standardized form, phase 42 corresponding to an acceleration of the rotation from a standstill to a speed value that is set or depends upon the machine speed. During the phase 43, the ink-duct roller 12 rotates at just this speed, that is constant if the machine speed is constant. The phase 44 characterizes a deceleration in the rotation of the ink-duct roller 12 down to a standstill, the ink-duct roller 12 being stationary again during phase 45. An overall view of the graphs a) and c) shows that the ink-duct roller 12 is stationary during a vibrator-roller cycle, i.e., while the vibrator roller 14 is in contact with the ink-duct roller 12, and rotates during several vibrator-roller cycles. The rotational cycle 46 is repeated periodically. The second reduced-ink operating mode, illustrated in the graph d), is characterized by or offers the feature that, on the first occasion upon which the vibrator roller 14 comes into contact with the ink-duct roller 12, the ink-duct roller 12 is stationary, on a single second occasion, directly following the first occasion, on which contact is made, the ink-duct roller 12 rotates, and on a third occasion, directly following the second occasion, on which contact is made, the ink-duct roller 12 is stationary again, and so on. This procedure and the rotational cycle 47, respectively, are repeated periodically, so that the vibrator roller 14 is alternately in contact with the stationary ink-duct roller and with the rotating ink-duct roller. The graph e) illustrates a third reduced-ink operating mode, in which, on a first occasion on which the vibrator roller 14 comes into contact with the ink-duct roller 12, the latter rotates, on at least two successive occasions, directly following the first occasion, on which contact is made, the ink-duct roller 12 is stationary, and on a further occasion on which contact is made, directly following the at least two occasions, the ink-duct roller 12 rotates again, and so on. During one vibrator-roller cycle and period of contact between the vibrator roller 14 and the ink-duct roller 12, respectively, the latter rotates, and the ink-duct roller 12 is stationary during a number of vibrator-roller cycles. The rotational cycle 48 of the ink-duct roller 12 is repeated periodically. In the reduced-ink operating modes illustrated in the graphs f) and g), the ink-duct roller 12 rotates only when it is not in contact with the vibrator roller 14. The fourth reduced-ink operating mode, illustrated in the graph f), is characterized by or offers the feature that, on a first occasion on which the vibrator roller 14 comes into contact with the ink-duct roller 12, the ink-duct roller 12 is stationary, following the first occasion, during an oscillating phase of the vibrator roller 14 towards the inking-unit roller 15 and back again towards the ink-duct roller 12, the ink-duct roller 12 rotates and, during a second occasion on which contact is made, directly following the first occasion, the ink-duct roller 12 is stationary again, and so on. The vibrator roller 14 makes contact only with the stationary ink-duct roller 12. In the interim, the ink-duct roller rotates a little further when the vibrator roller 14 is not in contact. The rotational cycle 49 is repeated periodically. Furthermore, it can be seen that the magnitude of the graduation of the ink reduction of the reduced-ink operating modes in relation to one another can be effected or increased as shown by varying the ink-duct roller speed. The speed n2 (the graph f) of FIG. 5) is lower than the speed n1 (the graph e) of FIG. 5). A reduced or lower amount of fresh ink is obtained by the ink-duct roller 12 continuing to rotate slowly between the times at which the vibrator roller 14 makes contact, and drawing less ink from the ink duct 11. It is possible to obtain no fresh ink at all by providing that the ink-duct roller 12 is also stationary between the times at which the vibrator roller 14 makes contact. In this manner, it is possible to achieve a change in the ink reduction within various operating modes even while maintaining the sequence of the ink-duct roller rotations in relation to the vibrator-roller movement. For example, the version illustrated in dot-dash lines in the graph e) and associated with the speed n3 represents an operating mode in which the ink is reduced considerably more in comparison with the version illustrated by solid lines and associated with the speed n1. The extent of the ink reduction may thus be varied by changing the rhythm of the ink-duct roller rotation and/or the magnitude of the speed. The graph g) illustrates a fifth reduced-ink operating mode, that is characterized by or offers the feature that the vibrator roller 14 makes contact with the ink-duct roller 12 many times in succession when the latter is stationary. The fifth operating mode is characterized by or offers the feature that, during a first oscillating or swinging phase of the vibrator roller 14 towards the inking-unit roller 15 and back again towards the ink-duct roller 12, the ink-duct roller 12 rotates, on at least two successive occasions, directly following the first oscillating or swinging phase, during which contact is made between the vibrator roller 14 and the ink-duct roller 12, the latter is stationary and, during a second oscillating or swinging phase of the vibrator roller 14 towards the inking-unit roller 15 and back again towards the ink-duct roller, directly following the at least two occasions on which contact is made, the ink-duct roller 12 rotates, and so on. The ink-duct roller 12 does not rotate a little further following each vibrator-roller cycle and each occasion on which contact is made between the vibrator roller 14 and the ink-duct roller, respectively, but only after a number of vibrator-roller cycles. The rotational cycle 50 is repeated periodically. The ink-duct roller 12 rotates discontinuously or intermittently in accordance with the movement characteristics illustrated in the graphs c) to g). The difference between the movement characteristic of each reduced-ink operating mode and the normal operating mode illustrated in the graph b) of FIG. 5 is that, in the normal operating mode, the ink-duct roller 12 rotates continuously, and in the reduced-ink operating modes, the ink-duct roller 12 rotates discontinuously.

I claim:

1. A method of operating a printing machine including an inking unit having a vibrator roller oscillatable reciprocatingly between an ink-duct roller and an inking-unit roller for making intermittent contact with the rollers, which comprises selectively operating the inking unit in a normal operating mode and in at least one reduced-ink operating mode, one of the reduced-ink operating modes includes rotating the ink-duct roller nonuniformly so that the oscillatable vibrator roller comes into contact with the ink-duct roller at least once when the ink-duct roller is rotating at a first speed, and comes into contact with the ink-duct roller at least once when the ink-duct roller is rotating at a second speed that is lower than the first speed.

2. The method according to claim 1, which includes continuously rotating the ink-duct roller in the normal operating mode.

3. The method according to claim 1, which includes rotating the ink-duct roller nonuniformly, in the at least one reduced-ink operating mode.

4. The method according to claim 1, which includes rotating the ink-duct roller discontinuously, in the at least one reduced-ink operating mode.

5. The method according to claim 1, which includes selectively operating the inking unit in one of a plurality of reduced-ink operating modes differing from one another with respect to the extent of the ink reduction therein.

6. The method according to claim 1, wherein the second speed has a zero value and the ink-duct roller is stationary when the vibrator roller makes contact with the ink-duct roller.

7. The method according to claim 1, which includes selecting the operating modes automatically by an electronic control device.

8. The method according to claim 1, which includes selecting the operating modes automatically by programmable electronic control equipment having a microprocessor.

9. A control method for implementing the operating method according to claim 1, which includes performing a selection of the operating modes and a changeover of the inking unit to the respectively optimal operating mode under program control by electronic control equipment.

10. A method of operating a printing machine including an inking unit having a vibrator roller oscillatable reciprocatingly between an ink-duct roller and an inking-unit roller for making intermittent contact with the rollers, which comprises:

selectively operating the inking unit in a normal operating mode and in at least one reduced-ink operating mode wherein the ink-duct roller rotates with a movement characteristic different from that of the normal operating mode; and performing a changeover from the normal operating mode to the at least one reduced-ink operating mode when, in the normal operating mode, the rotational speed of the ink-duct roller falls below a minimum value.

11. A printing machine, comprising:

an ink-duct roller;

an inking-unit roller;

a drive, separate from a main drive of the printing machine, for driving said ink-duct roller;

an inking unit having a vibrator roller reciprocatingly oscillatable between said ink-duct roller and said inking-unit roller and making intermittent contact with said rollers, said inking unit being constructed so as to be selectively operatable in a normal operating mode and in at least one reduced-ink operating mode wherein said ink-duct roller is rotatable nonuniformly by said drive so that said oscillatable vibrator roller makes contact with said ink-duct roller at least once when said ink-duct roller is rotating at a first speed, and makes contact with said ink-duct roller at least once when said ink-duct roller is rotating at a second speed that is lower than the first speed.

12. The printing machine according to claim 11, wherein said drive is a separate electric motor.

13. The printing machine according to claim 11, wherein, in the normal operating mode, said ink-duct roller is drivable by said drive so as to rotate continuously.

14. The printing machine according to claim 11, wherein, in the reduced-ink operating mode, said ink-duct roller is drivable by said driver so as to rotate nonuniformly.

15. The printing machine according to claim 11, wherein, in the reduced-ink operating mode, said ink-duct roller is drivable by said driver so as to rotate discontinuously.

16. The printing machine according to claim 11, wherein said inking unit is constructed so that it is selectively operatable in one of a plurality of reduced-ink operating modes differing from one another with respect to the extent of the ink reduction therein.

17. The printing machine according to claim 11, wherein the second speed has a zero value, and said ink-duct roller is stationary when said vibrator roller makes contact with said ink-duct roller.

18. The printing machine according to claim 11, including electronic control equipment for selecting the optimal operating mode and for switching the printing machine over to this operating mode.

19. The printing machine according to claim 18, wherein the selection and the switchover are performable as a function of current operating conditions on the printing machine.

* * * * *